United States Patent [19]

Nishizawa

[11] Patent Number: 4,980,619

[45] Date of Patent: Dec. 25, 1990

[54] SPEED CONTROL DEVICE FOR SEWING MACHINE

[75] Inventor: Yoshifumi Nishizawa, Nagoya, Japan

[73] Assignee: Mitsubishi Denki Kabushiki Kaisha, Tokyo, Japan

[21] Appl. No.: 379,139

[22] Filed: Jul. 13, 1989

[30] Foreign Application Priority Data

Jul. 19, 1988 [JP] Japan ..... 63-178121

[51] Int. Cl.[5] ..... H02P 7/00

[52] U.S. Cl. ..... 318/268; 318/66; 318/51

[58] Field of Search ..... 318/51, 53, 59, 66, 318/67, 268, 625; 112/217.2, 217.3, 275, 277

[56] References Cited

U.S. PATENT DOCUMENTS

| | | | |
|---|---|---|---|
| 4,257,103 | 3/1981 | Suzuki et al. | 318/625 X |
| 4,464,615 | 8/1984 | Rodi | 318/625 |
| 4,530,297 | 7/1985 | Fujikawa . | |
| 4,639,645 | 1/1987 | Hartwig | 318/51 |
| 4,641,069 | 2/1987 | Fujioka et al. | 318/51 X |
| 4,644,232 | 2/1987 | Nojiri et al. | 318/66 |
| 4,687,975 | 8/1987 | Suzuki | 318/261 |
| 4,837,491 | 6/1989 | Fujioka et al. | 318/51 |

FOREIGN PATENT DOCUMENTS 59-136093 8/1984 Japan .

*Primary Examiner*—Bentsu Ro

*Attorney, Agent, or Firm*—Sughrue, Mion, Zinn, Macpeak & Seas

[57] ABSTRACT

A sewing machine speed control device comprising: memory means for storing speed data representing the sewing speeds suitable for various types of sewing machines, sewing-machine-type selecting means for selecting a desired one of the various types of sewing machines and providing a sewing-machine-type selection signal for the selected type of sewing machine, data selecting means for reading the speed data of the selected type of sewing machine from the memory means in response to the sewing-machine-type selection signal, and speed control means for controlling the sewing speed of the selected sewing machine according to the speed data outputted by the data selecting means.

4 Claims, 2 Drawing Sheets

SPEED CONTROL DEVICE FOR SEWING MACHINE

BACKGROUND OF THE INVENTION

This invention relates to a speed control device for controlling the sewing speeds of various types of sewing machines, and more particularly to a speed control device for setting of sewing speeds separately according to the types of sewing machine to be used.

FIG. 1 shows the arrangement of a sewing machine driven by an electric motor, which comprises a sewing machine body 14, a sewing machine spindle 15, a pulley 16*a* fixedly mounted on the spindle 15, a sewing machine speed detector 17 for detecting the rotional speed of the sewing machine spindle 15, an electric motor 18 for rotating the sewing machine body 14, the rotary shaft 18 of the electric motor 18, a pulley 16*b* fixedly mounted on the rotary shaft 19, an endless belt 20 for transmitting the rotation of the pulley 16*b* to the pulley 16*a*, a sewing machine control unit 21, a motor speed detector for detecting the rotational speed of the motor 18, and a pedal 23 for varying the rotational speed of the motor 18.

In the sewing machine thus constructed, the pedal 23 is stepped in so that the sewing machine control unit 21 applies a signal to the motor 18 to rotate the motor 18. In response to the signal, the motor 18 starts to rotate and then the rotational force of the motor is transmitted through the pulley 16*b*, the endless belt 20 and the pulley 16*a* to the sewing machine spindle 15, so that the spindle 15 is rotated, that is, the sewing machine body 14 is actuated.

In this operation, the rotational speed of the motor 18 is detected by the motor speed detector 22 coupled to the rotary shaft 19 of the motor 18 and its information is supplied to the sewing machine control unit 21. On the other hand, the rotational speed of the sewing machine spindle 15 is detected by the sewing machine speed detector 17, and its information is supplied to the sewing machine control unit 21. The sewing machine control unit 21 controls the rotational speed of the motor 18, in a feedback mode, according to the rotational speed of the sewing machine spindle 15 thus detected so that the sewing machine body is actuated at a predetermined sewing speed.

FIG. 2 is a block diagram showing a conventional sewing machine speed control device for use in the sewing machine control unit 21. The conventional sewing machine speed control device as shown in FIG. 2 includes speed control means 1 comprising, for instance, a micro-computer for controlling the rotational speed of the sewing machine, variable resistors 2 to 5 for setting sewing speeds of the machine such as high speed, low speed, positioning speed and thread cutting speed in accordance with the operating modes of the sewing machine, which are connected between a DC control power source and ground, an analog switch 6 for selecting one of the sewing speeds determined respectively by the variable resistors 2 through 5, a sample-and-hold circuit 7 for holding for a predetermined period of time the selected sewing speed which is outputted by the analog switch, and A-D (analog-to-digial) converter 8 for converting the output analog signal of the sample-and-hold circuit 8 into a digital signal, and memory means 9 for storing data such as control constants.

In the case of controlling the sewing speed of the sewing machine body with the speed control device thus constructed, it is generally necessary to set the speed of the sewing machine body separately according to the high speed, low speed, positioning and thread cutting operations of the sewing machine body.

The operation of the speed control device as shown in FIG. 2, when the sewing machine body is operated in high speed mode, will be described hereinafter assuming that the high speed, low speed, positioning speed and thread cutting speed are set with the variable resistors 2, 3, 4 and 5, respectively.

In the high speed mode, the rotational (sewing) speed of the machine can be changed by adjusting the variable resistor 2; i.e., by changing the resistance of the resistor 2. When the resistance of the variable resistor 2 is changed, an analog signal (for instance, 0 to 5 V) corresponding to the control voltage is applied from the variable resistor to the analog switch 6. On the other hand, the analog switch 6 selects one of the input terminals and connects it to the common output terminal in response to a control signal provided by the speed control means 1 to thereby select one of the output analog signals of the variable resistors 2 through 5. When the input terminal connected to the variable resistor 2 is selected and connected to the common output terminal by the analog switch 6, the analog signal outputted from the variable resistor 2 is applied to the sample-and-hold circuit 7 as it is.

The input analog signal which changes with time is held by the sample-and-hold circuit 7 every predetermined period, and is supplied to the A-D converter 8. The analog signal inputted to the A/D converter is converted into a digital signal, and then applied to the speed control means 1. According to the digital signal, the speed control means 1 controls the rotational speed of the spindle in the sewing machine body 14 in high speed mode. For instance, when the output voltage of the variable resistor 2 is 0 V, the rotational speed of the spindle of the sewing machine body 14 is controlled to 100 rpm; and when the output voltage of the variable resistor 2 is 5 V, the rotational speed of the spindle of the sewing machine body 14 is controlled to 4000 rpm. That is, the rotational speed in the high speed mode can be varied in the range of from 100 rpm to 4000 rpm by changing the output voltage of the variable resistor 2 in the range of 0 to 5 V.

In the low speed, positioning and thread cutting modes, similarly as in the above-described high speed mode, the variable resistors 3, 4 and 5 are changed in resistance and the analog switch 6 is operated separately according to these operations by the speed control means, so that the sewing speed of the sewing machine body 14 is suitably controlled.

In the conventional sewing machine speed control device thus constructed, the resistor 2 through 5 are operated to determine the sewing speed of the sewing machine body which is used in high speed, low speed, positioning or thread cutting mode. Therefore, in the case where different sewing machine bodies are used and they are driven at different speeds separately according high speed, low speed, positioning and thread-cutting operations for each sewing machine body, it is necessary to adjust the resistances of the variable resistors and change the sewing speeds for each sewing machine. However, this operation is rather troublesome.

SUMMARY OF THE INVENTION

An object of this invention is to eliminate the above-described difficulty accompanying a conventional sewing machine speed control device. More specifically, an object of the invention is to provide a sewing machine speed control device which, when different types of sewing machines are used, can readily set the sewing speeds of the sewing machines which are used in high speed, low speed, positioning and thread-cutting modes.

To attain the above object, a sewing machine speed control device according to the invention is characterized in that data on the sewing speeds of various types of sewing machines are beforehand stored in memory means, and in response to a sewing-machine-type selection signal provided by a sewing-machine-type selecting means, the speed data of the corresponding sewing machine are read from the memory means and applied to a speed control means, so that the speed of the sewing machine is controlled according to the speed data thus provided.

In the sewing machine speed control device of the invention, information on the sewing speeds of various types of sewing machines is separately stored as speed data according to the operation modes for each type of sewing machine. The speed data of the sewing machine to be used is selected and read out, so that the sewing speed of the sewing machine is controlled suitably according to the speed data for the type of the used sewing machine.

DETAILED DESCRIPTION OF THE INVENTION

Figure 1:
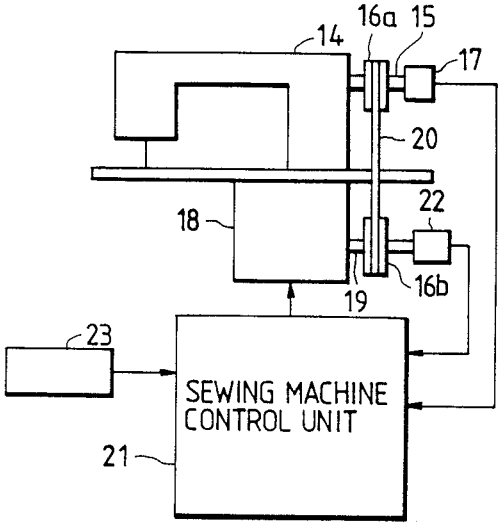
FIG. 1 is an explanatory diagram showing the entire arrangement of a sewing machine.
Figure 2:
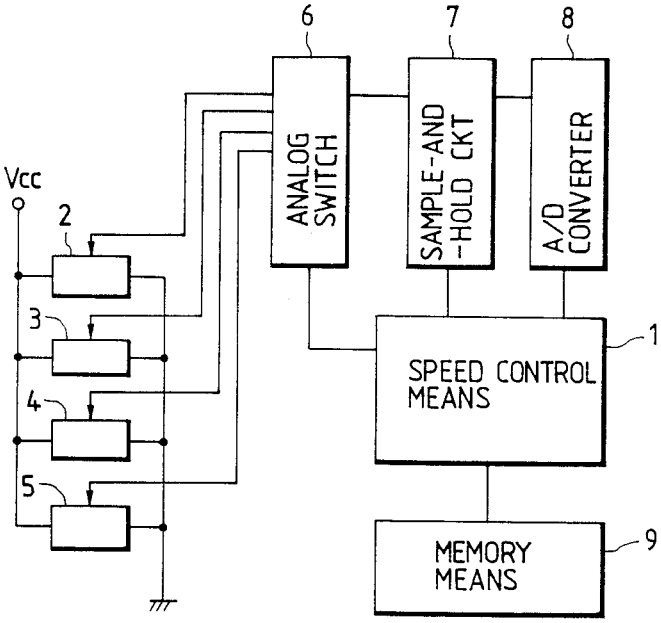
FIG. 2 is a block diagram showing a conventional sewing machine speed control device.
Figure 3:
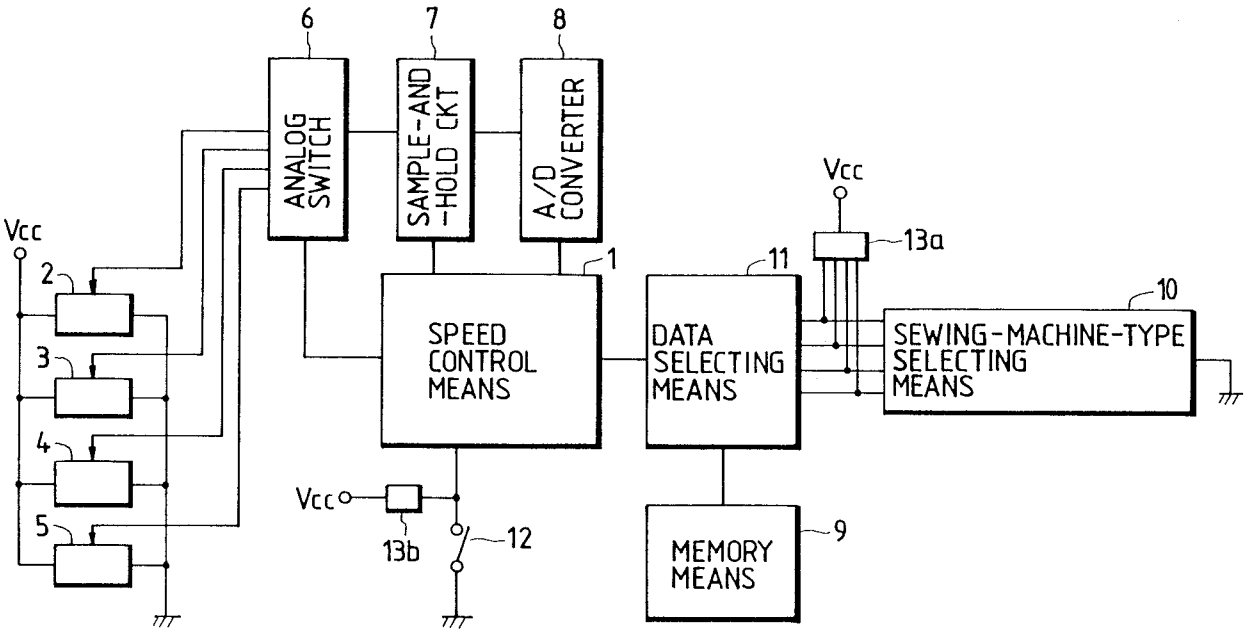
FIG. 3 is a block diagram showing one embodiment of this invention.

The preferred embodiment of this invention will be described hereinunder with reference to the accompanying drawings. FIG. 3 is a block diagram showing the arrangement of one embodiment of this invention. In FIG. 3, reference numerals 1 through 9 designate the same circuit elements as those in FIG. 2. In the memory means 9, information on the sewing speeds of different types of sewing machines which are determined separately according to the high speed, low speed, positioning and thread cutting modes thereof have been beforehand stored in advance for each type of sewing machine. Reference numeral 10 designates sewing-machine-type selecting means comprising a hexadecimal select switch for selecting one of the types of sewing machines and outputting a sewing-machine-type selection signal; 11, data selecting means for reading, in response to the sewing-machine-type selection signal provided by the sewing-machine-type selecting means 10, the corresponding speed data of each type of the sewing machines from the memory means 9 and supplying them to the speed control means 1; 12, speed data switching means for selecting one of the speed data provided by the data selecting means 11 and the speed data provided by the A-D converter in the speed control means 1, the selected speed data being used as a sewing speed control data for the sewing machine to be used; and 13*a* and 13 *b*, pull-up resistors for the sewing-machine-type selecting means 10 and the speed data switching means 12.

The operation of the speed control device thus contructed will be described.

When the speed data switch means 12 is turned on, a low level signal "0" is applied to the speed control means 1. On the other hand, when speed data switch means 12 is turned off, a high level signal "1" is applied to the speed control means 1. Assuming that, when the signal "1" is applied to the speed control means 1 by the speed data switching means 12, the speed control means 1 sets the speed data provided by the A-D converter 8 as speed set data, similarly as in the case of the above-described conventional speed control device, the speed control means 1 controls the sewing speeds of the sewing machine according to the speeds set by the variable resistors 2 through 5.

On the other hand, when the sewing machine whose speed data have been stored in the memory means 9 is used, the data switching means 12 is turned off to apply the low level signal "0" to the speed control means 1, so that in the speed control means 1 the speed set data is switched over to the speed data provided by the data selecting means 11. On the other hand, inputting means (not shown) is operated to input information on the type of the sewing machine to the sewing-machine-type selecting means 10, so that the sewing-machine-type selection signal is applied to the data selecting means 11 by the sewing-machine-type selecting means 10.

It is assumed that two different sewing machines A and B are used, and the rotational speeds (rpm) of the sewing machines A and B in high speed, low speed, positioning and thread-cutting modes are as indicated in the following Table 1:

TABLE 1

| mode / machine type | High speed | Low speed | Positioning | Thread-cutting |
|---|---|---|---|---|
| A | 4000 | 200 | 250 | 250 |
| B | 3000 | 250 | 200 | 250 |

In addition, it is assumed that when the sewing machine A is selected, the sewing-machine-type selection signal from the sewing-machine-type selecting means 10 is set to "0", and when the sewing machine B is selected, it is set to "1".

When the sewing machine A is selected, the sewing-machine-type selection signal "0" is applied to the data selecting means 11. Upon reception of the sewing-machine-type selection signal "0", the data selecting means 11 reads the data on the speeds (as shown in Table A) of the sewing machine according to the high speed, low speed positioning and thread-cutting modes of the machine A from the memory means 9, and applied them to the speed control means 1. For instance, when the sewing machine A is operated in high speed mode, a signal representing the rotational speed 4000 rpm is applied to the speed control means 1, and the speed control means 1 controls the rotational or sewing speed of the sewing machine A by setting the rotational speed 4000 rpm to the speed set data. In the case where the sewing machine is operated in low speed mode, in positioning mode, or in thread cutting mode, similarly as in the above-described case, the speed control means 1 control the rotational or sewing speed of the sewing machine according to the speed data provided by the data selecting means 11.

In the case where the sewing machine B is selected, the sewing-machine-type selecting means 10 applies the sewing-machine-type selection signal "1" to the data selecting means 11 so that the data selecting means 11 reads the speed data of the sewing machine B from the memory means 9 and the speed control means 1 controls the speed of the sewing machine B according to the speed data thus read.

As described above, the speed data stored in the memory means 9 and the speed data determined by the variable resistors 2 through 5 are selectively switched to each other by the speed data switching means 12 and the selected data is set as speed set data, so that, even if a sewing machine other than those whose speed information have been stored in the memory means 9 is used, the sewing operation can be carried out at the speed suitable for the used sewing machine.

In the above-described embodiment, two different sewing machines are used. However, since the hexadecimal select switch is used as the sewing-machine-type selecting means 10, sixteen (16) different sewing machines can be selectively used. The same effect can be obtained by selectively operating the switches which are respectively provided for the different sewing machines in place of using the hexadecimal select switch as the sewing-machine-type selecting means 10.

In the above-described embodiment, the speed for different sewing machines are stored in the memory means 9. However, in addition to the speed information, other control constants such as pulley ratios, sewing machine $GD^2$, maximum torque, proportional constants for position control when the machine is not actuated, and proportional constant for speed control when the machine is not actuated may be stored in the memory means 9. In this case, those data can read out by the data selecting means 11 for each type of sewing machine.

As described above, in the sewing machine speed control device according to the invention, the speed information of different types of sewing machines are separately stored as speed data in a memory according to the operating modes, and when any one of the sewing machines is selected, the speed data of the sewing machine thus selected are read out to thereby control the speeds of the sewing machine according to the speed data thus read. Therefore, when a sewing machine is replaced by another type of sewing machine, speeds suitable for the exchanged sewing machine can be readily set using the speed control device of the invention. Hence, in the case where various types of sewing machines are controlled with one control means, the sewing machines can be easily switched over to one another.

What is claimed is:

1. A sewing machine operation control device for controlling at least one of the operating parameters of sewing machines, each being driven by an electric motor and having a plurality of operating modes; comprising:

memory means for storing first speed data representing the sewing speeds suitable for each of the plurality of operating modes of each of various types of sewing machines said first speed data comprising at least four types of data used in high speed, low speed, positioning speed and thread cutting speed modes, respectively;

sewing-machine-type selecting means for selecting a desired one of said various types of sewing machines and providing a sewing-machine-type selection signal for the selected type of sewing machine;

data selecting means for reading first operating data of the selected type of sewing machine from said memory means in response to said sewing-machine-type selection signal; and operation control means, comprising a microcomputer, for controlling the operation of the selected sewing machine in each of its plurality of operating modes according to the operating data outputted by said data selecting means.

2. A sewing machine speed control device for controlling the sewing speed of a sewing machine driven by an electric motor comprising:

memory means for storing first speed data representing the suitable for various types of sewing machines;

sewing-machine-type selecting means for selecting a desired one of said various types of sewing machines and providing a sewing-machine-type selection signal for the selected type of sewing machine;

data selecting means for reading speed data of the selected type of sewing machine from said memory means in response to said sewing-machine-type selection signal;

speed control means for controlling the sewing speed of the selected sewing machine according to the speed data outputted by said data selecting means;

plural variable resistors for setting sewing speeds of a sewing machine, in accordance with operation modes;

an analog switch for selecting one of the sewing speeds determined by said variable resistors;

a sample-and-hold circuit for holding the selected sewing speed for a predetermined period of time;

an A/D converted for converting an output analog signal of said sample-and-hold circuit into a digital signal and outputting the digital signal to said speed control means as second speed data; and speed data switching means for selecting one of the first and second speed data and using the selected speed data as a sewing speed control data for the sewing machine to be used.

3. A sewing machine speed control device as claimed in claim 2, wherein each of said first and second speed data comprises four types of data used in high speed, low speed, positioning speed and thread-cutting speed modes, respectively.

4. A sewing machine speed control device as claimed in claim 3, wherein said speed control means comprises a microcomputer.

* * * * *